US012337378B2

(12) United States Patent
Del Boccio

(10) Patent No.: US 12,337,378 B2
(45) Date of Patent: Jun. 24, 2025

(54) CASTING CORE POST AND SOCKET JOINT

(71) Applicant: RTX Corporation, Farmington, CT (US)

(72) Inventor: Anthony J. Del Boccio, Charlottesville, VA (US)

(73) Assignee: RTX Corporation, Farmington, CT (US)

( * ) Notice: Subject to any disclaimer, the term of this patent is extended or adjusted under 35 U.S.C. 154(b) by 0 days.

(21) Appl. No.: 18/779,406

(22) Filed: Jul. 22, 2024

(65) Prior Publication Data

US 2025/0025933 A1 Jan. 23, 2025

Related U.S. Application Data

(60) Provisional application No. 63/528,295, filed on Jul. 21, 2023.

(51) Int. Cl.
*B22C 9/10* (2006.01)

(52) U.S. Cl.
CPC ..... *B22C 9/103* (2013.01)

(58) Field of Classification Search
CPC ..... B22C 9/10; B22C 9/103; B22C 21/14
See application file for complete search history.

(56) References Cited

U.S. PATENT DOCUMENTS

| | | | |
|---|---|---|---|
| 7,144,220 | B2 | 12/2006 | Marcin, Jr. |
| 8,813,812 | B2 | 8/2014 | Kamel et al. |
| 10,987,727 | B2 | 4/2021 | Propheter-Hinckley |
| 11,440,146 | B1 | 9/2022 | Paulus et al. |
| 2020/0338630 | A1 | 10/2020 | Beele |

*Primary Examiner* — Kevin P Kerns
*Assistant Examiner* — Steven S Ha
(74) *Attorney, Agent, or Firm* — Bachman & LaPointe, P.C.

(57) ABSTRACT

A casting core assembly has: a first ceramic piece including a projecting post; a second ceramic piece including a socket; and a ceramic filler material between the post and the socket. In transverse section at at least one location one of the post and socket has a configuration of: three circumferentially offset radial peaks of a peak radius ($R_{PMAX}$, $R_{SMAX}$); and three radial troughs of a trough radius ($R_{PMIN}$, $R_{SMIN}$) not more than 98.0% of the peak radius.

20 Claims, 15 Drawing Sheets

CASTING CORE POST AND SOCKET JOINT

CROSS-REFERENCE TO RELATED APPLICATION

Benefit is claimed of U.S. Patent Application No. 63/528,295, filed Jul. 21, 2023, and entitled "Casting Core Post and Socket Joint", the disclosure of which is incorporated by reference herein in its entirety as if set forth at length.

BACKGROUND

The disclosure relates to gas turbine engines. More particularly, the disclosure relates assembly of ceramic casting core pieces to each other.

Gas turbine engines (used in propulsion and power applications and broadly inclusive of turbojets, turboprops, turbofans, turboshafts, industrial gas turbines, and the like) have components cast with internal passageways (e.g., for cooling). The passageways may be cast over casting cores such as in an investment casting process.

In such casting, core assemblies may be used. Some assemblies include separate ceramic pieces assembled to each other. In some examples, one ceramic piece may be molded having projections or posts whereas a mating ceramic piece may be molded having respective associated sockets or holes.

Example posts and sockets have essentially circular transverse cross-section. The post may have a slight proximal-to-distal taper in order to facilitate mold release. Similarly, the socket may have an opening-to-base taper. If a flexible mold (e.g., elastomeric such as silicone) is used, the taper or drift may not be needed. Such an elastomeric mold may be used to manufacture core shapes that would not be removable from a hard die due to backlocking. The elastomeric mold may be a liner for a hard (e.g., metallic) tool. After molding, the tool may disengage from the liner and then the liner may be removed from the molded core.

In general, in the assembled condition, there will be a very slight radial clearance. An example radial clearance is about 0.003 inch (0.08 mm). The clearance or gap may be filled with a ceramic filler material (e.g., alumina- and/or silica-based material applied as a paste and subsequently cured). An example paste is introduced by injecting into the socket or applying to the tip of the post prior to core assembly.

In one example, the posts are on the inboard/inside face of a skin core near the upstream end (relative to internal cooling flow of the cast part) thereof. An opposite downstream end portion of the skin core may embed in a shell to cast outlets or may be spaced apart from an interior wall of the shell so that outlets must be subsequently machined in the casting. The sockets are in a feed core. The posts may be taller than the sockets are deep so that, in the assembled condition, the posts protrude from the sockets holding adjacent surface portions of the two cores surrounding the posts and sockets spaced apart from each other for casting an interior wall section of the component. If the posts are shorter, one or both of the cores may be molded with tapering bumpers (e.g., conical, frustoconical, and/or domed) near the posts that contact the other to provide a desired spacing for casting the wall section. In such a situation, the contact between the bumper and other core may leave a small hole in the wall.

After decoring, the exposed portion of each post leaves an associated feed aperture from the feed passageway into the skin passageway.

U.S. Pat. No. 10,987,727B2 (the '727 patent), of Propheter-Hinckley, Apr. 27, 2021, and entitled "Investment Casting Core System", the disclosure of which is incorporated by reference herein in its entirety as if set forth at length, discloses posts or pins of a skin core received in sockets or holes in a feed core. The particular variation shown involves the feed core having an access slot open to the hole. The slot provides access for an injector to inject a ceramic bonding agent.

SUMMARY

One aspect of the disclosure involves a casting core assembly comprising: a first ceramic piece including a projecting post; a second ceramic piece including a socket; and a ceramic filler material between the post and the socket. In transverse section at at least one location one of the post and socket has a configuration of: three circumferentially offset radial peaks of a peak radius ($R_{PMAX}$, $R_{SMAX}$); and three radial troughs of a trough radius ($R_{PMIN}$, $R_{SMIN}$) not more than 98.0% of the peak radius.

In a further embodiment of any of the foregoing embodiments, additionally and/or alternatively, the socket is a closed-ended socket.

In a further embodiment of any of the foregoing embodiments, additionally and/or alternatively: the trough radius is 93.0% to 97.0% the peak radius if said one is the post; and the trough radius is 93.0% to 97.0% the peak radius if said one is the socket.

In a further embodiment of any of the foregoing embodiments, additionally and/or alternatively, in said transverse section at said at least one location the post has: respective convex regions spanning maxima of the peaks; and respective essentially straight regions spanning minima of the troughs.

In a further embodiment of any of the foregoing embodiments, additionally and/or alternatively, in said transverse section at said at least one location the socket has: a radius of a minima within 5.0% of a radius of a maxima.

In a further embodiment of any of the foregoing embodiments, additionally and/or alternatively, the casting core assembly further comprises: a second said post and a second said socket and a ceramic filler material between the second post and the second socket.

In a further embodiment of any of the foregoing embodiments, additionally and/or alternatively, said at least one location forms at least 30% of a depthwise overlap $H_O$ of the post and socket.

In a further embodiment of any of the foregoing embodiments, additionally and/or alternatively, a separation $H_G$ between the first ceramic piece and the second ceramic piece aside the projection and socket is 0.40 mm to 1.2 mm.

In a further embodiment of any of the foregoing embodiments, additionally and/or alternatively, the second ceramic piece forms a feedcore; and the first ceramic piece forms a skin core.

In a further embodiment of any of the foregoing embodiments, additionally and/or alternatively, the first ceramic piece has one or more bumpers protruding to contact the second ceramic piece.

In a further embodiment of any of the foregoing embodiments, additionally and/or alternatively, a method for manufacturing the casting core assembly comprises: molding the first and second ceramic pieces; injecting a ceramic paste into the socket; and inserting the post into the socket partially displacing the ceramic paste and causing the ceramic paste to flow outward at the radial troughs of the post or the radial peaks of the socket.

In a further embodiment of any of the foregoing embodiments, additionally and/or alternatively, the method further comprises firing the first and second pieces after molding.

In a further embodiment of any of the foregoing embodiments, additionally and/or alternatively, the inserting also causes the ceramic paste to flow outward between the radial troughs of the post or the radial peaks of the socket.

In a further embodiment of any of the foregoing embodiments, additionally and/or alternatively, a method for using the casting core assembly comprises: wax overmolding; shelling to form a shell; and casting an alloy in the shell.

In a further embodiment of any of the foregoing embodiments, additionally and/or alternatively, the method of further comprises deshelling and decoring.

In a further embodiment of any of the foregoing embodiments, additionally and/or alternatively, the radial troughs are along flats of the post.

A further aspect of the disclosure involves a casting core assembly comprising: a first ceramic piece including a projecting post; a second ceramic piece including a socket; and a ceramic filler material between the post and the socket. The post and socket are shaped so that with the post centered within the socket in transverse section at at least one location the post and socket define a gap having: three circumferentially offset first locations of local minimum radial span; and three circumferentially offset second locations of local maximum radial span.

In a further embodiment of any of the foregoing embodiments, additionally and/or alternatively, a method for forming the casting core assembly comprises: introducing a ceramic paste into the socket; and inserting the post into the socket.

In a further embodiment of any of the foregoing embodiments, additionally and/or alternatively, the second locations of local maximum radial span are at outward recesses in the socket or flats of the post.

A further aspect of the disclosure involves a casting core assembly comprising: a first ceramic piece including a projecting post; a second ceramic piece including a socket; and a ceramic filler material between the post and the socket. The post and socket are shaped to provide means for improving flow of the ceramic filler while preserving a centering effect.

In a further embodiment of any of the foregoing embodiments, additionally and/or alternatively, the means may comprise circumferentially alternating local radial maxima and minima on at least one of the post and socket. If on both the post and socket, the radial maxima and minima of the post may respectively be in phase with the radial maxima and minima of the socket (e.g., up to 5.0° or 3.0° off exact in-phase).

The details of one or more embodiments are set forth in the accompanying drawings and the description below. Other features, objects, and advantages will be apparent from the description and drawings, and from the claims.

BRIEF DESCRIPTION OF THE DRAWINGS

Like reference numbers and designations in the various drawings indicate like elements.

DETAILED DESCRIPTION

Post and socket bonding involves tight geometries (e.g., 0.003 inch (0.08 mm) nominal radial gap). This is required by balancing alignment precision (favoring smallest gap) against manufacturing tolerance (e.g., of spacing of posts and sockets).

The example bonding material is a ceramic filler material. Such material is typically alumina and/or silica fines (e.g., 0.00001 inch to 0.0005 inch (0.25 micrometers to 13 micrometers) in size) delivered as a paste (e.g., with a carrier of water or colloidal silica-such colloidal silica may be used with alumina and/or silica fines). This thick paste may lock up under high shear and prevent full assembly of the post and hole. Lockup may particularly occur when the substrate absorbs liquid from the paste, causing the paste to thicken before target insertion is achieved (and prevent full insertion). The slurry may be thinned by adding more water or colloidal silica. However, water creates many problems in fired cores, both at core processing (e.g., the creation of a boundary layer between the adhesive and ceramic preventing chemical or mechanical attachment) and at the foundry (e.g., excessive water may affect wax patterns by causing swelling and limiting adhesion of wax to the cores). Water mitigation is expensive and time consuming (normally extended time in an oven or kiln to fully dry the ceramic).

Also, the geometries may trap air under the post causing mechanical or chemical bonds to not take place. The cast blade material can flow into the voids, blocking airflow in the cast part.

In order to provide a beneficial combination of precise positioning, ease of post-to-socket mating, and avoidance of complications of thin slurry, post and/or socket cross-section may be altered from the pure circular-sectioned baseline.

Figure 1:
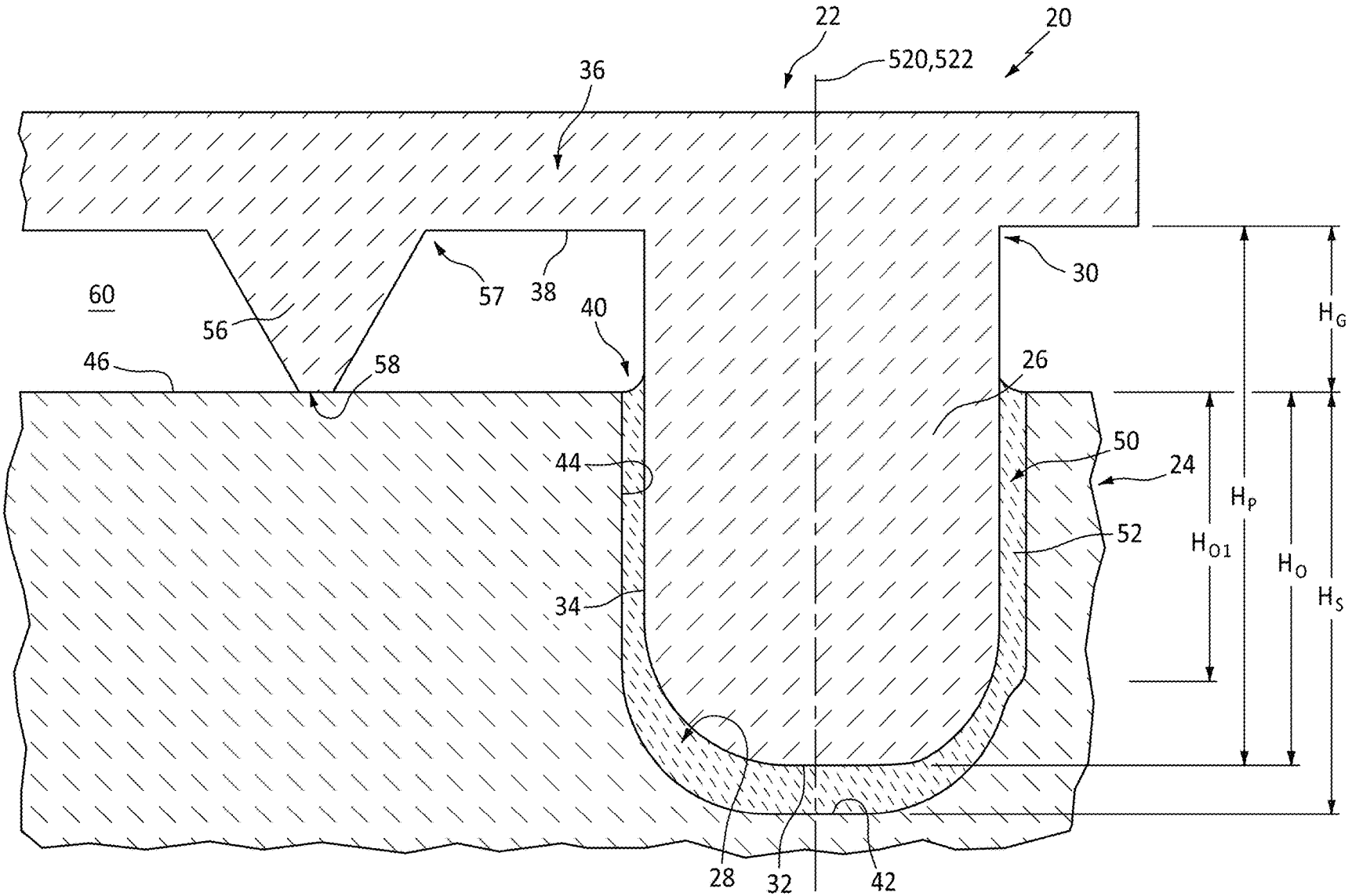
FIG. 1 is a longitudinal sectional view of a casting core post-and-socket joint.

FIG. 1 shows a core assembly 20 having first core piece (first piece or first core) 22 having an integrally molded projection (post) 26 extending from a proximal end (root end) 30 to a free distal end (tip) 32 and having a peripheral wall surface 34. The proximal end merges with the remainder (e.g., at a body section 36) of the first piece which has a surface region 38 surrounding the proximal end 30. The post has a central axis (centerline) 520 and a height or length $H_P$.

FIG. 1 shows a second core piece (second piece or second core) 24 having an integrally molded socket 28. The example socket is a blind or closed-ended socket rather than a through-hole. Thus, the socket extends from an open outer end (opening) 40 to an inner base end (base) 42 and has a peripheral wall surface 44. As with the projection proximal end, the socket outer end or opening is to a surrounding outer surface 46. The socket has a central axis 522 and a height or depth $H_S$.

In a particular assembled condition with the post 26 coaxially seated (centered) in the socket 28, the gap 50 between them is filled with a ceramic filler material 52. As noted above, in the example implementation, the first core has bumpers 56 protruding from the surrounding surface 38. Each bumper extends from a proximal (root) end 57 to a distal end 58 that contacts the second core surrounding surface 46 so that the surrounding surfaces 38 and 46 are spaced apart from each other by a gap 60 that has a height $H_G$ which corresponds to the thickness of an internal wall to be cast.

As noted above, an alternative example in implementation, the post is sufficiently taller $H_P$ than the socket is deep $H_S$ so that the post bottoms in the socket and the surrounding surfaces 38 and 46 are spaced apart from each other by the gap 60 of height $H_G$ without bumpers 56. In either situation, there is an axial/heightwise overlap span or zone of the post and socket having an overlap height $H_O$.

In use, as in the '727 patent, the second piece 24 may form a feed core and the first piece 22 may form a skin core/outlet core such as for casting an airfoil element (blade or vane). In such a situation, there may be two or more such projections 26 on the first piece received in corresponding sockets 28 in the second piece so as to substantially fully position the first piece relative to the second piece against movement transverse to the post/socket centerlines.

Manufacturing tolerances for either of the pieces highlight the need for nominal clearances/gaps between the projections the sockets. For example, manufacturing tolerances may cause the centerlines 520 of the projections of a given first piece to be slightly closer to or further away from each other than the centerlines 522 of the sockets of a given second piece to which they are to mate. Thus, the nominal clearance is engineered in to allow such tolerance with limited scrappage. However, too much clearance and core alignment is compromised. Thus, increasing annular clearance between a circular socket and circular post to facilitate paste flow may reduce the positional accuracy of the two cores.

A prior art post 26' and socket 28' (FIG. 2) of circular cross-section and respective radii $R_P$ and $R_S$ thus would have a nominal (ignoring manufacturing tolerances/variation) uniform centered gap of radial clearance $R_{G0}$.

In distinction and departure from a possible baseline, the post and/or socket has other than a circular cross-section along a portion of its height or depth and, in particular, along a portion of the overlap height $H_O$. The post cross-section has three evenly circumferentially spaced lobes 80 (FIG. 3) with radial maxima of radius $R_{PMAX}$ at locations 82 and three evenly spaced radial minima of radius $R_{PMIN}$ at locations 84 exactly out of phase with the maxima. The example maxima are intact portions of a circular section (having angular span $\theta_{CP}$) that may correspond to the circular section of the FIG. 2 baseline post 26'.

Figure 3:
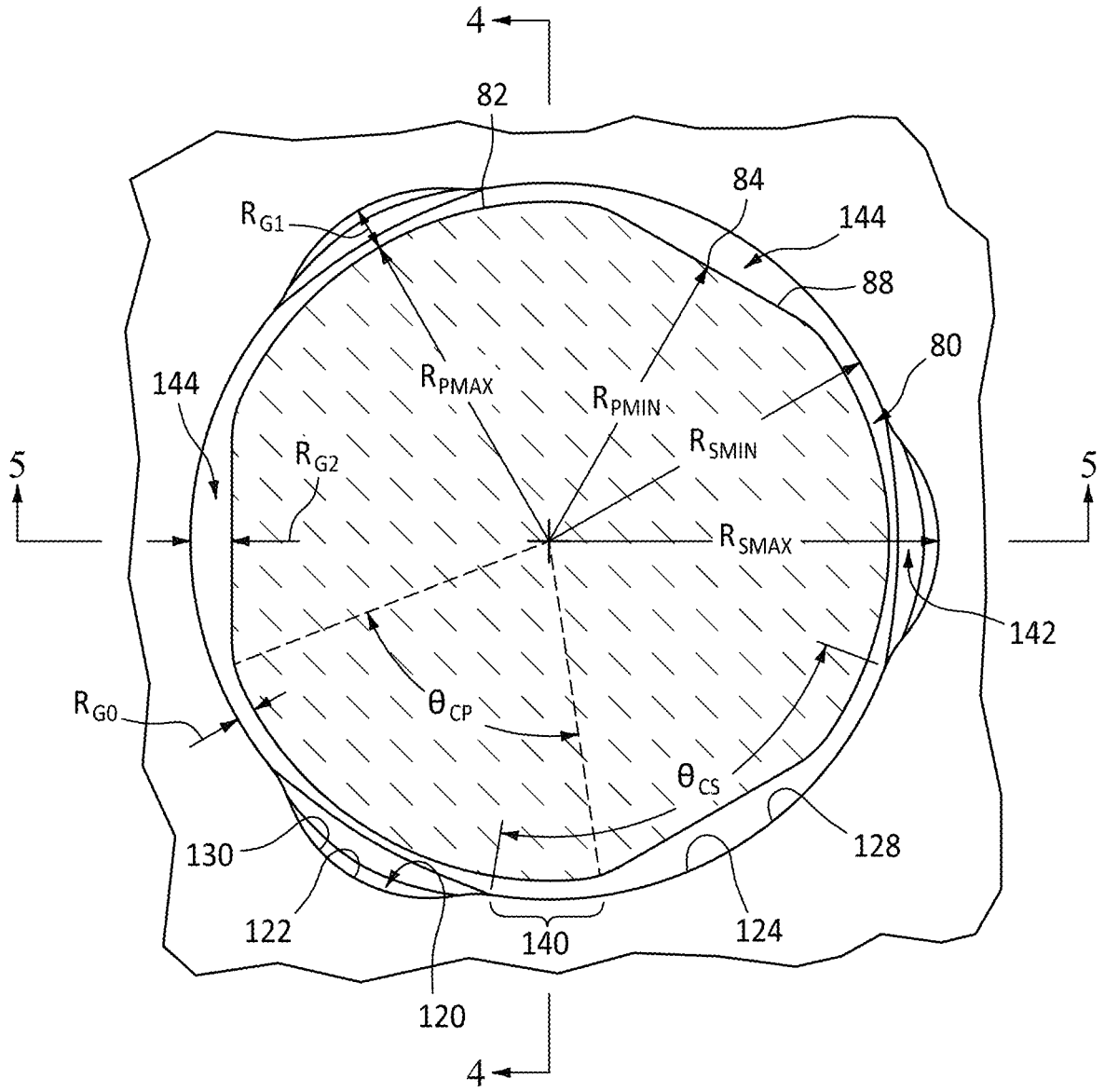
FIG. 3 is a transverse sectional view of the FIG. 1 joint without bonding agent.
Figure 4:
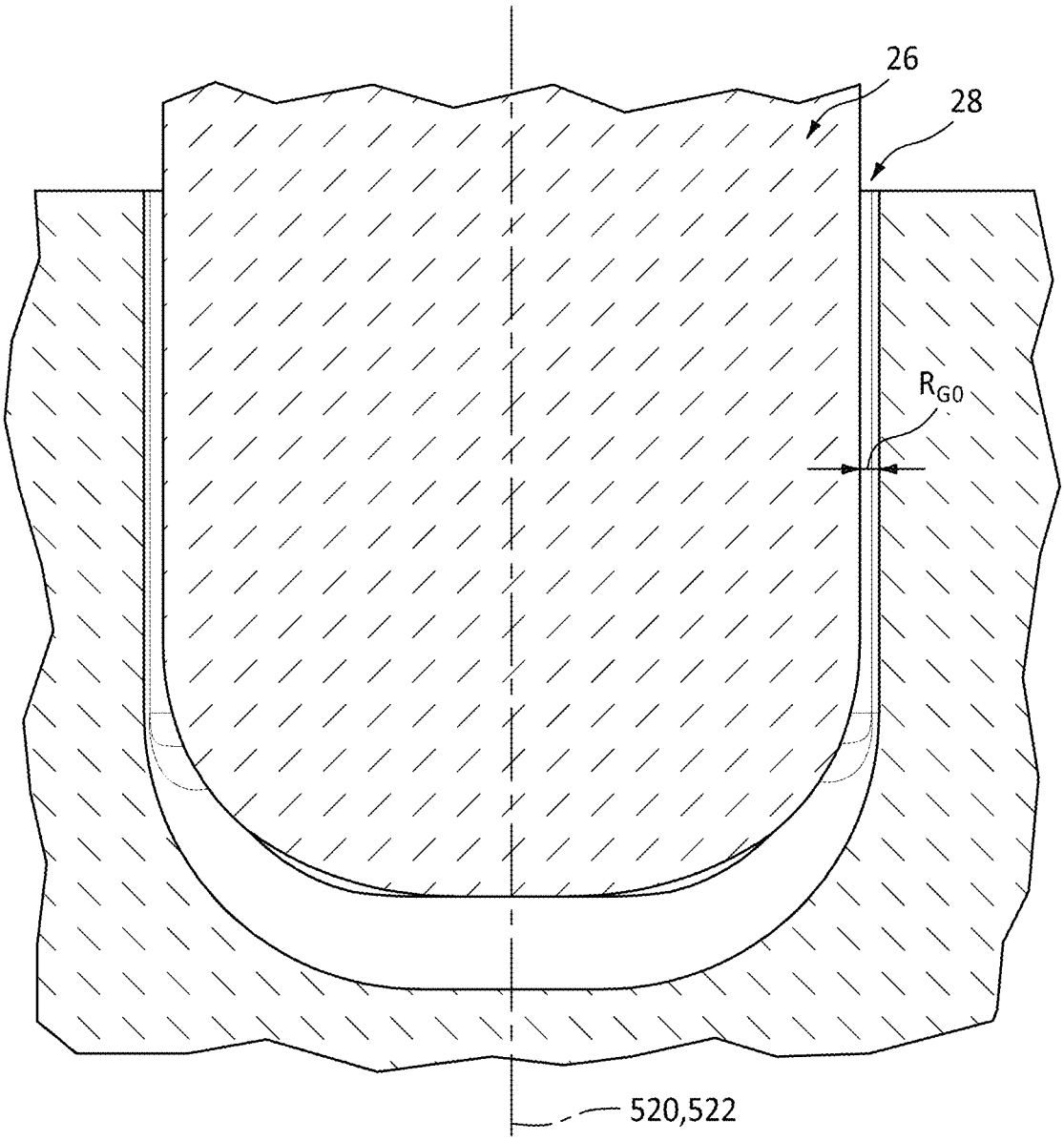
FIG. 4 is a longitudinal sectional view of the FIG. 3 joint taken along line 4-4 of FIG. 3.
Figure 5:
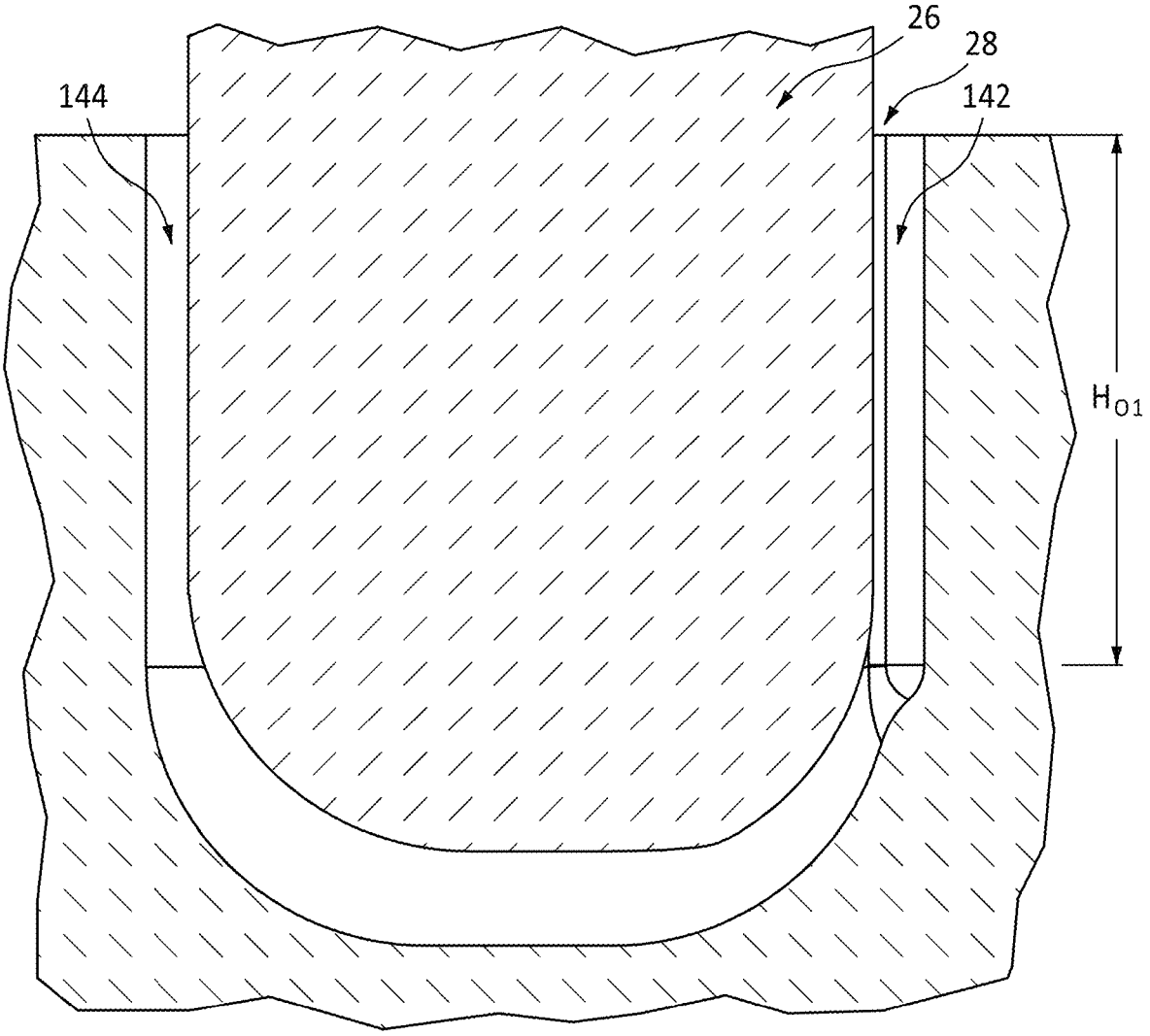
FIG. 5 is a longitudinal sectional view of the FIG. 3 joint taken along line 5-5 of FIG. 3.
Figure 6:
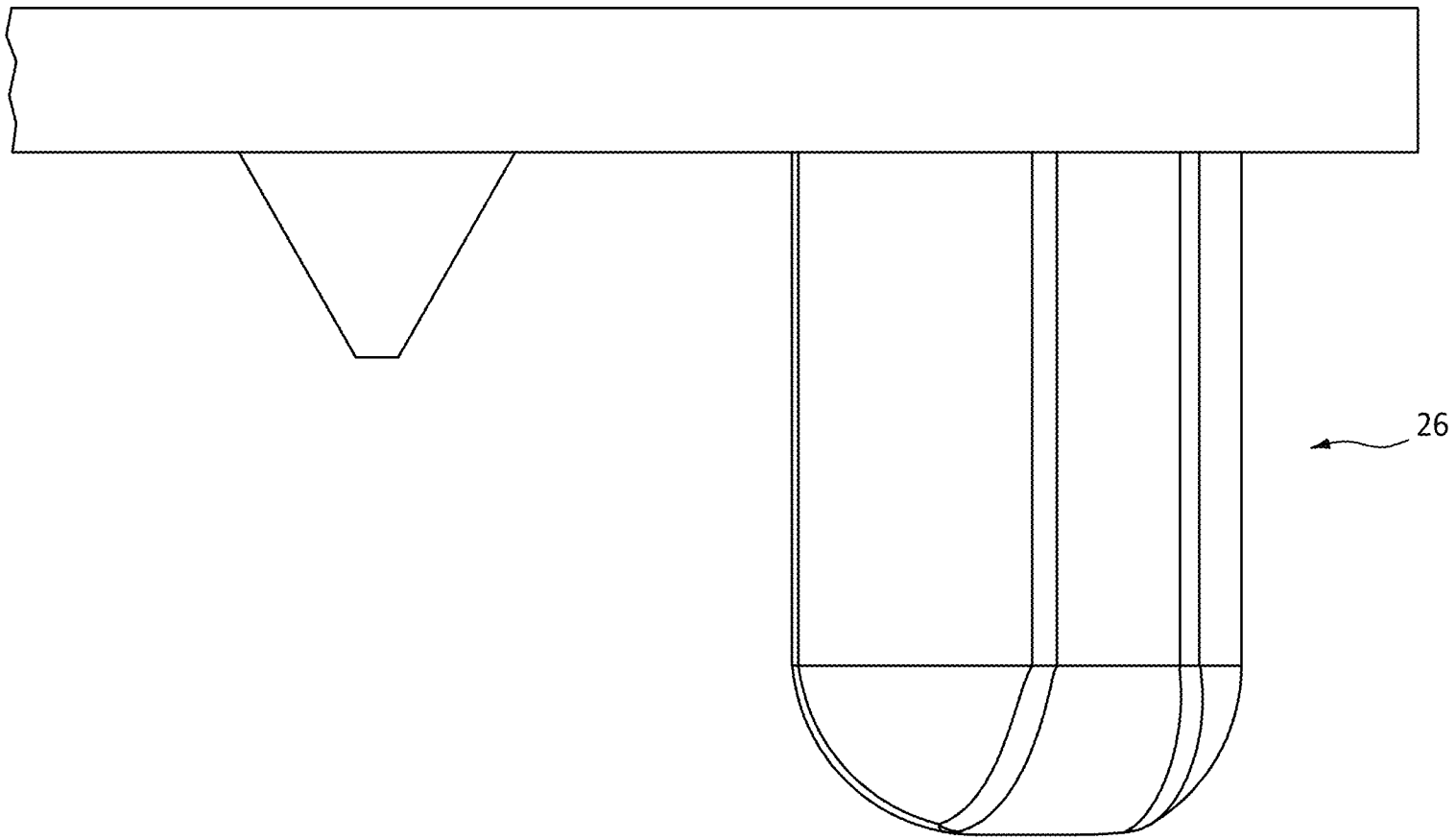
FIG. 6 is a side view of a post of the joint of FIG. 3.
Figure 7:
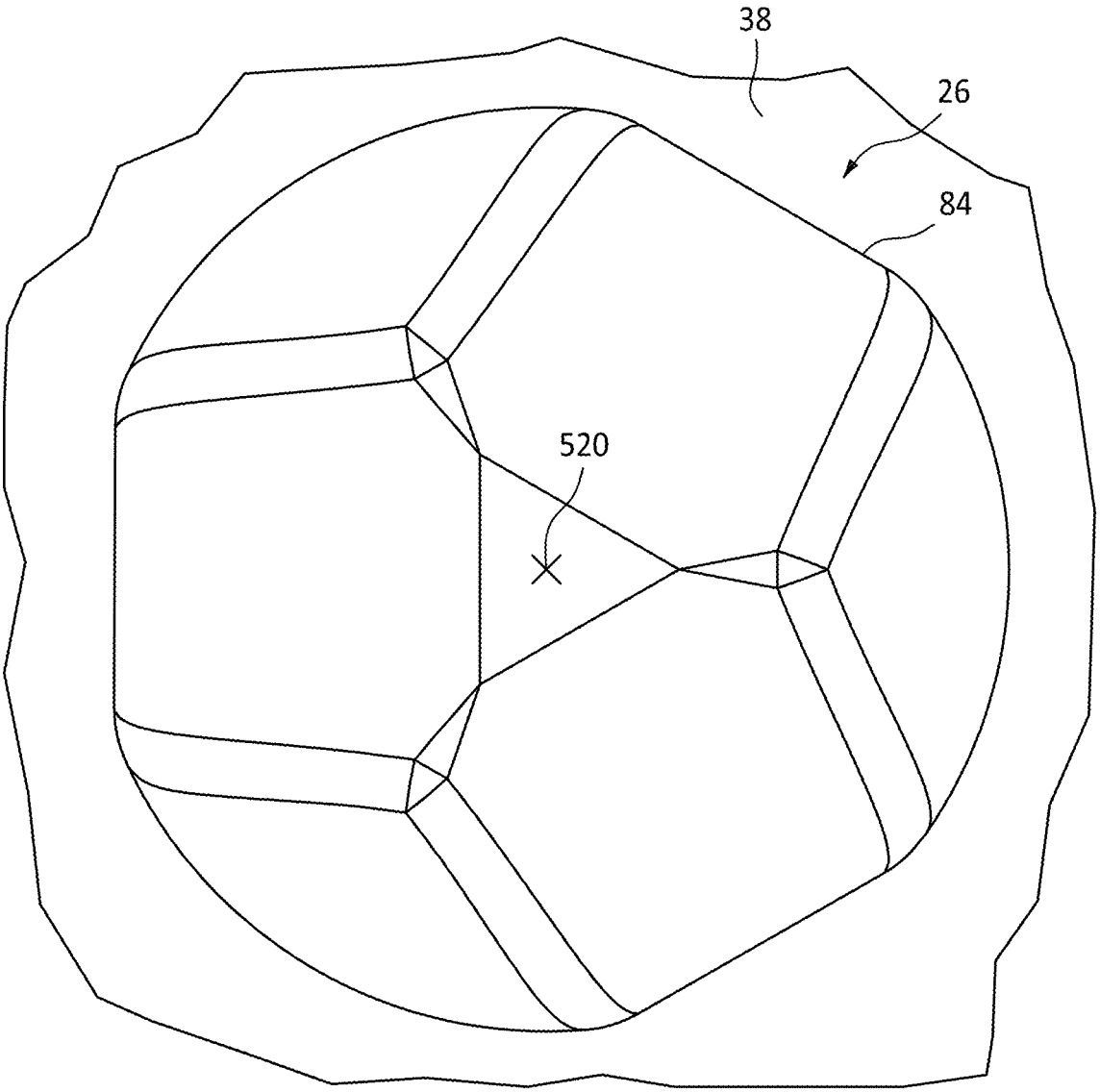
FIG. 7 is an end view of the post of FIG. 6.
Figure 8:
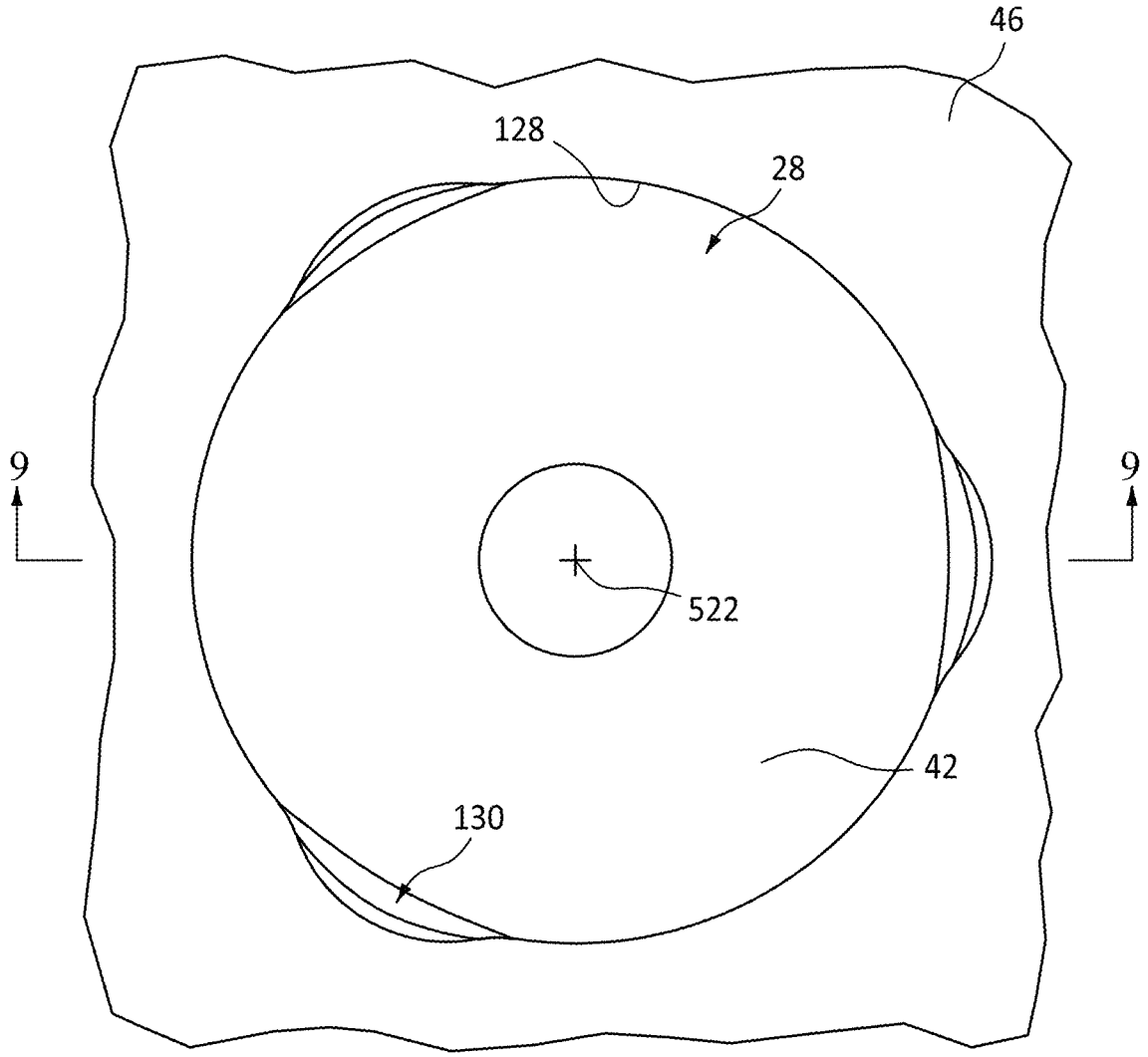
FIG. 8 is an inward view of the socket of the joint of FIG. 3.
Figure 9:
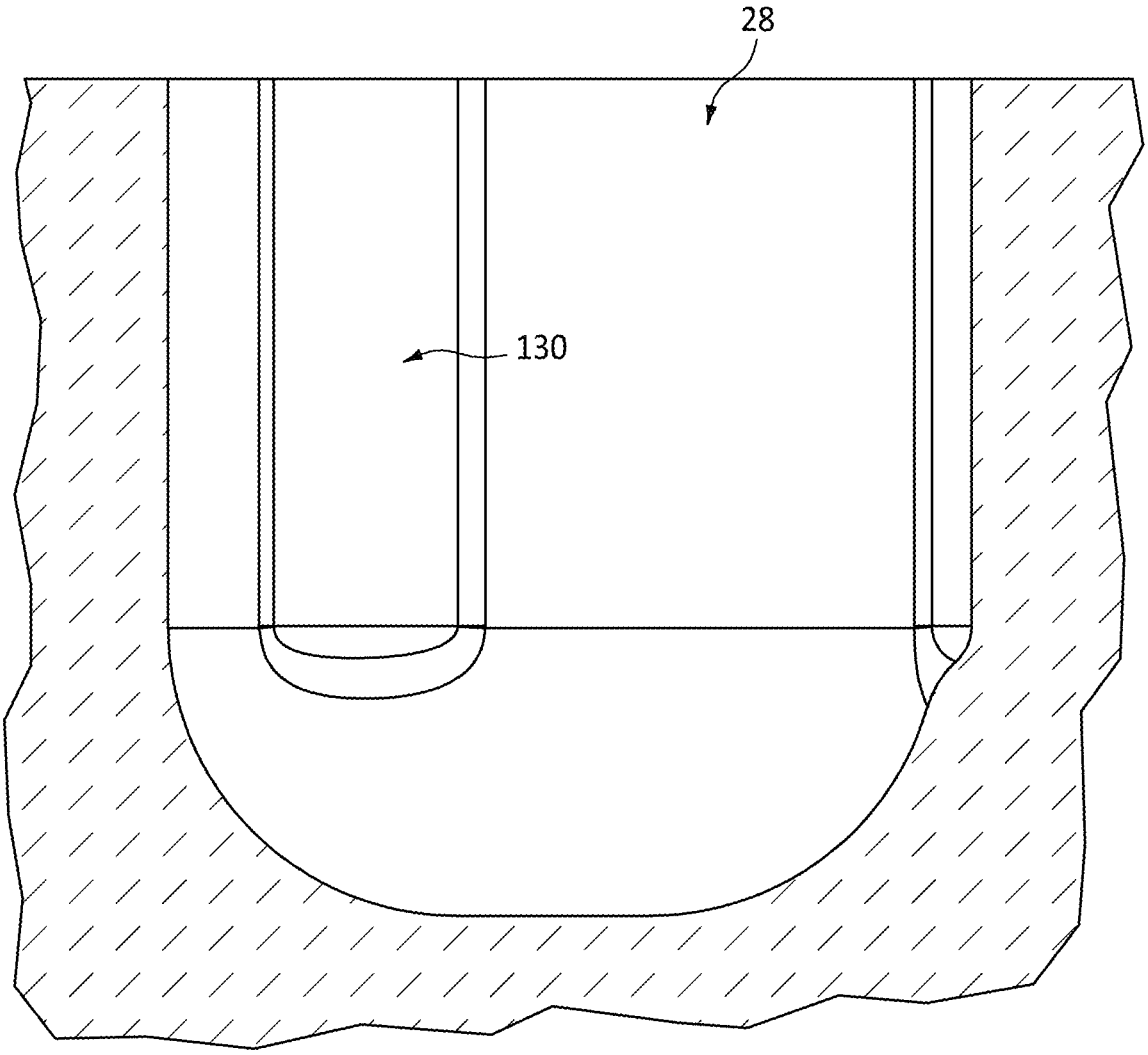
FIG. 9 is a longitudinal sectional view of the FIG. 8 socket taken along line 9-9 of FIG. 8.

The example minima 84 are centrally along flats 88 (straight lines in the transverse sectional view of FIG. 3). The example maxima are true peaks; whereas, the example minima are not true troughs. True troughs would reflect a local concavity in the peripheral surface. The example cross-section has regions of convexity centered on the maxima transitioning to straight regions centered on the minima. However, when plotted as radius against angular position for 360° cycle, the maxima represent peaks and the minima represent troughs. The example flats may be exact flats or may be substantial flats or may be arcs with substantially greater radii of curvature than that their actual local radii or the radius of curvature at the maxima. Example radii of curvature substantially are at least 500% or at least 1000% of the local radii or the radius of curvature along the maxima. There may even be local concavity at the minima, however that may reduce post strength and the additional surface area may resist flow and if extending into the gap it may further reduce the area of the feed hole it casts.

The socket cross-section has three evenly circumferentially spaced lobes 120 with radial maxima at locations 122 and three evenly spaced radial minima at locations 124 exactly out of phase with the maxima. The example minima are intact portions 128 of a circular section (having angular span $\theta_{CS}$) that may correspond to the circular section of the FIG. 2 baseline socket. The example maxima are centrally along recesses 130 (convex outward in the transverse sectional view of FIG. 3) in the wall of the socket. FIG. 1 shows an overlap subregion of height $H_{O1}$ where both the post and the socket have such fully formed features 88 and 130. In this example, the height $H_{O1}$ ignores a filleted lower/inboard end of the recess 130. The socket maxima are along inward concavities of the surface that convexly transition at circumferential ends to the concavity where the minima occur. The latter may be intact portions of a circle.

The recesses 300 (FIG. 3) have a peak radius $R_{SMAX}$. The intact circular portions define a socket minimum radius $R_{SMIN}$. The angular spans $\theta_{CP}$ and $\theta_{CS}$ are sized so that there is overlap region 140 of intact circular surface portions of the post and socket surfaces which would share local nominal radial gap $R_{G0}$ with the FIG. 2 baseline if engineered therefrom by merely eliminating material at the post flats and socket recesses (e.g., preserving $R_P$ as $R_{PMAX}$ and $R_S$ as $R_{SMIN}$). For this, $\theta_{CP}+\theta_{CS}>120°$ for the three-cycle/lobe/recess configuration. example $\theta_{CP}+\theta_{CS}$ is 130° to 160°, more narrowly 140° to 155° or about 150°. An example overlap span of region 140 is 10° to 40° or 20° to 35 or 20° to 35°. Example $\theta_{CP}$ may be slightly smaller than $\theta_{CS}$. With the example sum of 150°, example $\theta_{CP}$ is 62° and example $\theta_{CS}$ is 88°. More broadly, example $\theta_{CP}$ is 50° to 90°, more particularly 55° to 80° and example $\theta_{CS}$ is 60° to 105°, more particularly 75° to 95°.

Centered, the radial gap at the post peaks is a radial clearance $R_{G1}$ and at the post troughs $R_{G2}$. These effectively create two groups of three enhanced radial span channels (radially enhanced portions of the annular gap) 142, 144 to facilitate flow of paste/slurry upon insertion of the post into the socket. Each channel 142 is diametrically opposite an associated channel 144.

In describing the departures from circularity of the post and socket cross-sections, various relative or absolute dimensions may be provided. Several alternative characterizations are provided because, for example, some characterizations may be more readily applicable when alternatively describing a post or a socket with the present features in a combination with the other lacking the features; whereas other characterizations may be more applicable when describing a combined situation where both have the features; and whereas other characterizations may be applicable when merely describing the features of a post or a socket in isolation.

As is discussed below, various of these characterizations/relationships may be measured at a single location along the overlap span/zone/height $H_O$ or over a portion thereof. Depending on the implementation, this may be over a percentage of $H_O$ such as at least 20% or at least 30% or at least 40%. Each of those lower limits may be coupled with an upper limit, if any, of 50% or 70% or 80% or 90% or 99% or 100%. However, clearly, individual features on one or both may extend past the overlap region (e.g., post features extending into the gap 60 as shown or socket features extending below the post distal end 32).

To facilitate characterizations, a reference dimension may either be the minimum radius or the maximum radius regardless of which one, if either, may represent the intact circular cross-section. Thus, for either, a hypothetical proportion might be the ratio of the maximum radius to minimum radius (or vice-versa) even though the maximum radius is the intact portion of the post circular cross-section and the minimum radius is the intact portion of the socket circular cross-section.

Example $R_{G0}$ is 3.0% to 10.0% of the radius ($R_{PMAX}$ in FIG. 3) at the circular portion of the post, more particularly 4.5% to 7%. Example radius of said intact circular portion of the post is 0.80 mm to 1.0 mm, more particularly, 0.85 mm to 0.95 mm.

Example $R_{G1}$ is 10% to 30% of the radius $R_{PMAX}$ at the circular portion of the post, more particularly 10% to 20% or 12% to 18% or 13% to 15%. Example $R_{G1}$ is 150% to 400% of $R_{G0}$, more particularly 150% to 300% or 175% to 200%.

Example $R_{G2}$ is 10% to 20% of the radius $R_{PMAX}$ at the circular portion of the post, more particularly 12% to 18% or 13% to 15%. Example Re is 150% to 400% of $R_{G0}$, more particularly 150% to 300% or 175% to 200%. In general, too large a gap area at the features in cross-section will reduce bias to drive material up through the intact portion of the smaller annular gap $R_{G0}$.

Example height $H_G$ of gap 60 is 0.35 mm to 2.0 mm, more particularly, 0.40 mm to 1.2 mm or 0.50 mm to 0.70 mm.

Looking only at the post, an example difference between $R_{PMAX}$ and $R_{PMIN}$ is at least 2.0% of $R_{PMAX}$ or at least 5.0% or at least 10.0%, alternatively, 2.0% to 20.0% or 5.0% to 15.0% or 10% to 20% of $R_{PMAX}$.

Looking only at the socket, an example difference between $R_{SMAX}$ and $R_{SMIN}$ is at least 2.0% of $R_{SMAX}$ or at least 5% or at least 10%, alternatively, 2.0% to 20.0% or 5.0% to 15.0% or 10% to 20% of $R_{SMAX}$.

Regarding centering/positioning, the nominal configuration allows the baseline closure of the value of radial gap $R_{G0}$ at locations where both circular sections are intact. This represents the minimum movement. Greater closure may occur at the locations of $R_{G1}$ and $R_{G2}$, but the gaps will not fully close due to contact aside the gaps. Thus, the movement clearance will be only slightly greater than $R_{G0}$.

In one extreme relative to an otherwise optimized baseline, $R_{G0}$ may be the same as baseline $R_{G0}$. Then one gives up a little bit of radial constraint in the directions post radial minima and socket radial maxima and potentially a little strength of post but one gains gap height post radial minima and socket radial maxima and thus reduces flow/shear issues for the paste or slurry.

Figure 2:
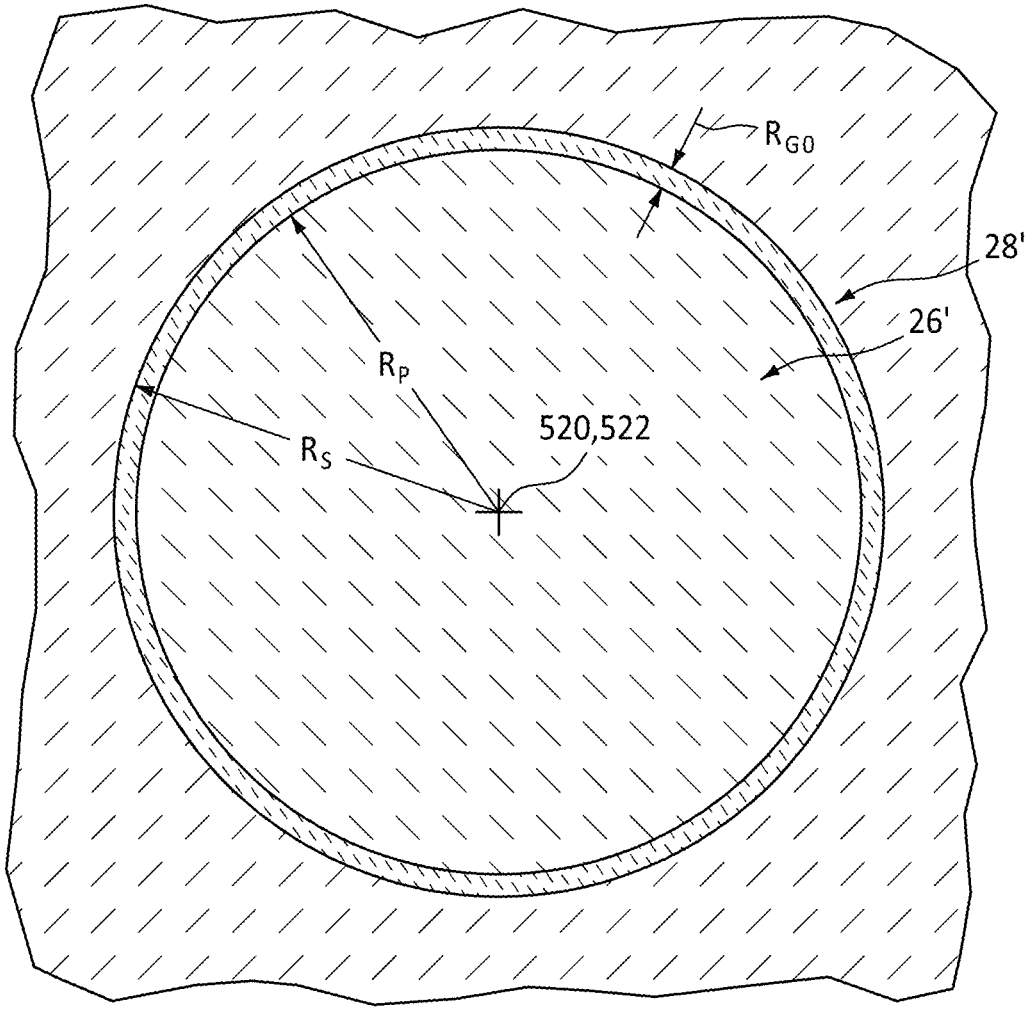
FIG. 2 (PRIOR ART)
FIG. 2 is a transverse sectional view of a prior art casting core post-and-socket joint.

At another end of the spectrum, one may reduce $R_{G0}$ relative to FIG. 2 baseline $R_{G0}$ so as to obtain a generally similar overall positioning. Whereas the reduced nominal gap may locally limit effective flow at the regions 140, the increased gaps at either side may make up for this.

Along a majority of a length of the post, a draft angle of the peripheral surface is 0.5°. More broadly, an example draft is 0° to 1.0°, measured as a full angle rather than a half angle. Along a majority of a length (depth) of the socket, a draft angle of the peripheral surface is about 5°. More broadly, an example draft is 1.0° to 10°, measured as a full angle rather than a half angle. Given these relatively small draft angles, even if different from each other, the post and socket may have the aforementioned dimensional relationships/proportions along a substantial fraction of the overlap height in the ranges noted above not withstanding that the individual radii change slightly with height.

However, particularly with a disparity in draft angle, the target relationships may exist over a much smaller fraction of $H_O$. For example, the draft angle of the socket may be greater than the draft angle of the post. This disparity, for example, causes an increase in cross-sectional area of the gap axially outward towards the surface 46. This reduces the sensitivity of the level of the surface of the material 52 relative to the surface 46. For example, even with precise amounts of material introduced, the variations in the height of the bumper/projection/protrusion 56 will influence the depth of penetration of the post into the socket and thus the displacement of material.

Figure 16:
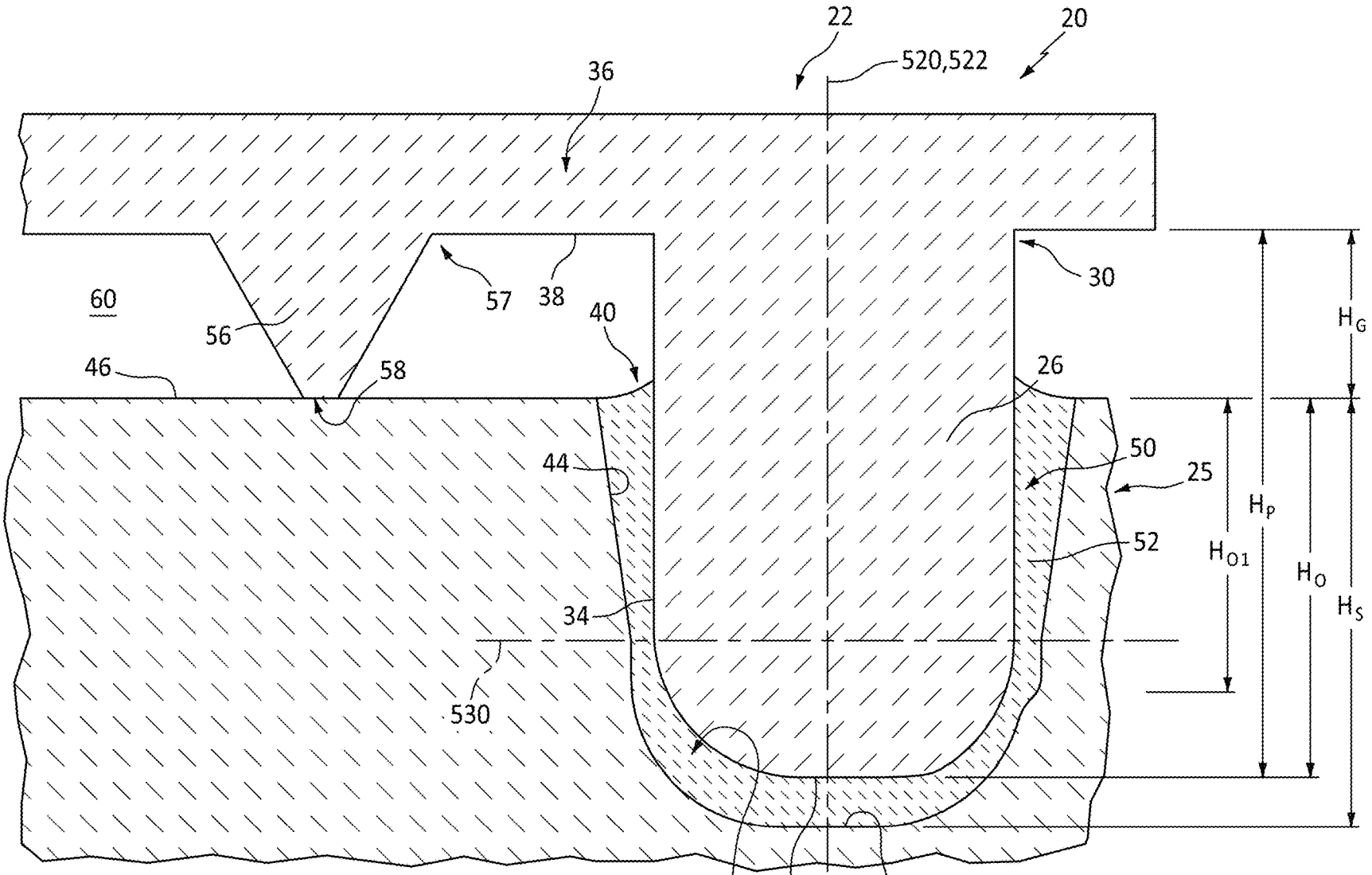
FIG. 16 is a longitudinal sectional view of a third alternate joint.

FIG. 16 shows a relatively highly tapered (high draft angle) socket in a second piece 25 receiving a relatively less tapered or untapered post. As discussed above, this leads to a greater gap radius approaching the surface 46 and thus a greater gap cross-sectional area. This greater gap cross-sectional area reduces prospective overflow or under-flow of the material 52 relative to the surface 46. In this example, both the post and socket have the features and the socket recesses extend all the way to the surface 46. Thus, toward the surface 46, the gaps may increase above the numbers discussed elsewhere. However, the gaps may retain the identified relationships at a single location or at an area relatively down in the socket so as to retain positioning accuracy. In this example, the area is a region at or at and slightly above a location 530 where the axial cross-section of the post begins to taper toward the tip 32.

A broader radial span of the gap means that excessive insertion will cause a smaller overflow height of material protrusion beyond the surface 46. This provides more favorable manufacturing tolerances for the wall thickness of the wall cast by the gap 60. For example, a slightly short bumper 56 already reduces wall thickness. Because the overflow imposes a further local thickness reduction on the wall, there can be problems. The tapered socket reduces that further local reduction relative to what it otherwise would have been. Similarly, in an under-flow situation where the surface of the material 52 does not reach the surface 46, the height of the burr in the passageway cast by the core 24 is smaller and may be more likely to be within manufacturing tolerance.

Figure 10:
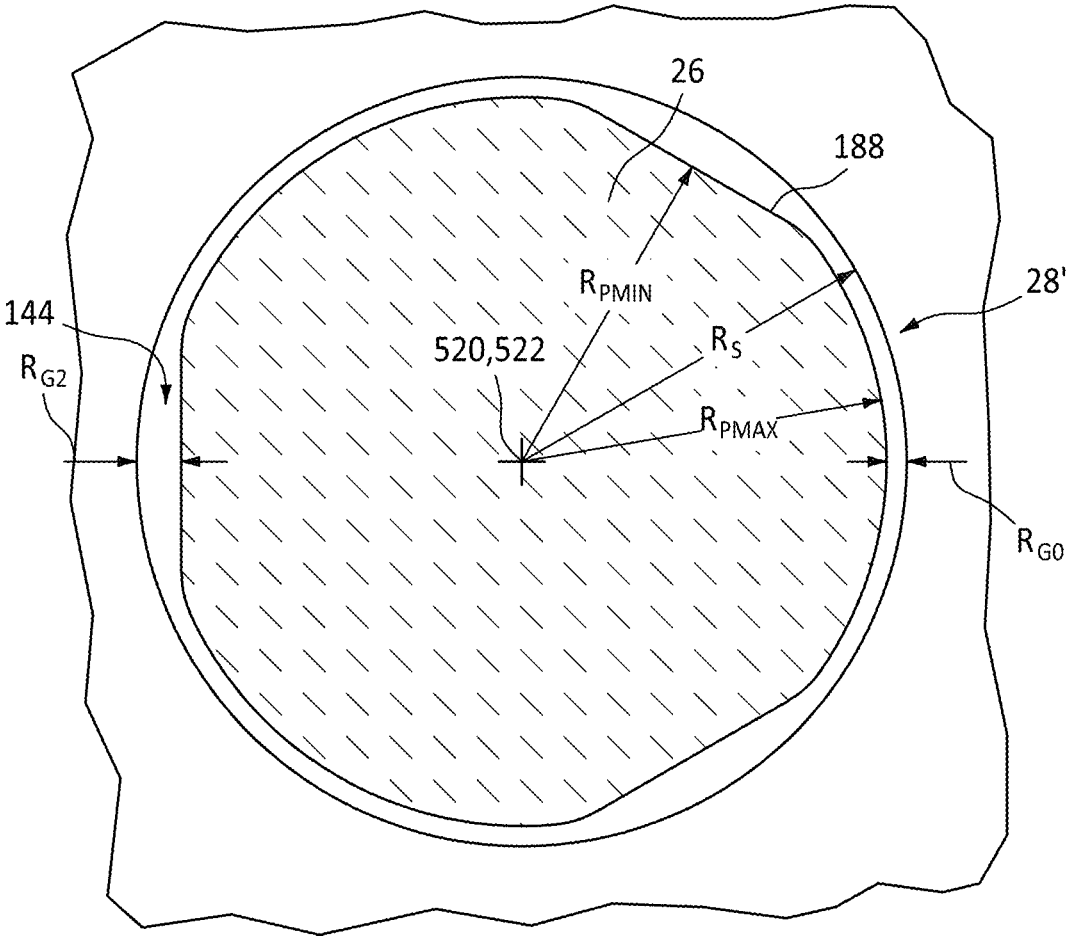
FIG. 10 is a transverse sectional view of a first alternate joint without bonding agent.

FIG. 10 shows an example of a situation wherein the post has the varying diameter but the socket is circular (e.g., as the FIG. 2 baseline socket 28'). Thus, there are three regions 144 of enhanced radial gap but each is diametrically opposite a region of aligned circular sections having the gap $R_{G0}$.

Figure 11:
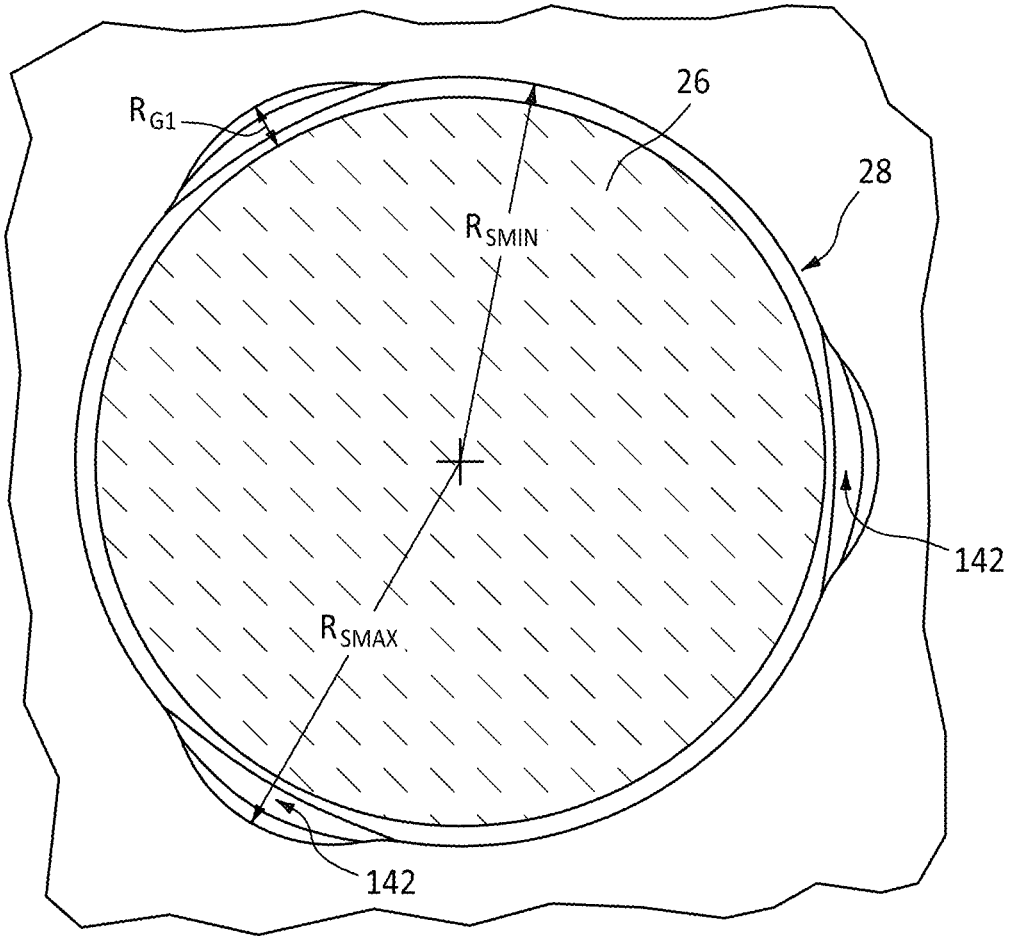
FIG. 11 is a transverse sectional view of a second alternate joint without bonding agent.

FIG. 11 shows an example of a reversed situation wherein the socket 28 has the varying diameter and the post is circular (e.g., as the FIG. 2 baseline post 26'). Thus, there are three regions 142 of enhanced radial gap but each is diametrically opposite a region of aligned circular sections having the gap $R_{G0}$.

A key advantage of the FIG. 10 and FIG. 11 embodiments are associated with one of the post and socket retaining its circular section is that there is much greater angular overlap of intact circular surfaces. With off-centered contact, there is thus a more advantageous force distribution with less contact pressure and less risk of damage to the core having the features than if there was just partial overlap due to both pieces having the features.

An example tight tolerance of a circular section/portion radius is 2.0% variation between the maximum and minimum values However, in practice tolerances may be broader such as 5.0% or 7.0% and potentially up to about 10.0%.

Figure 12:
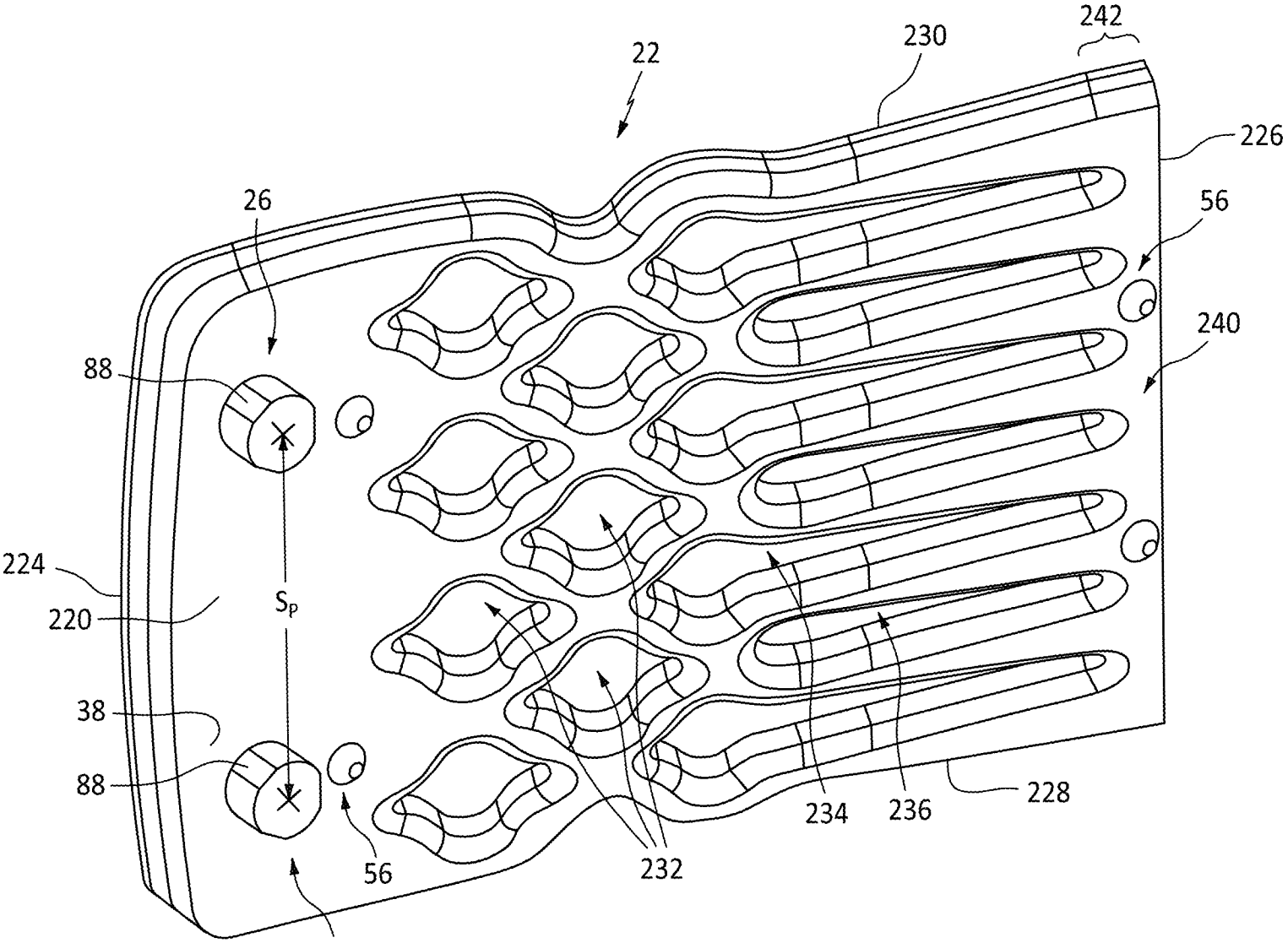
FIG. 12 is a view of an example core having the posts.
Figure 13:
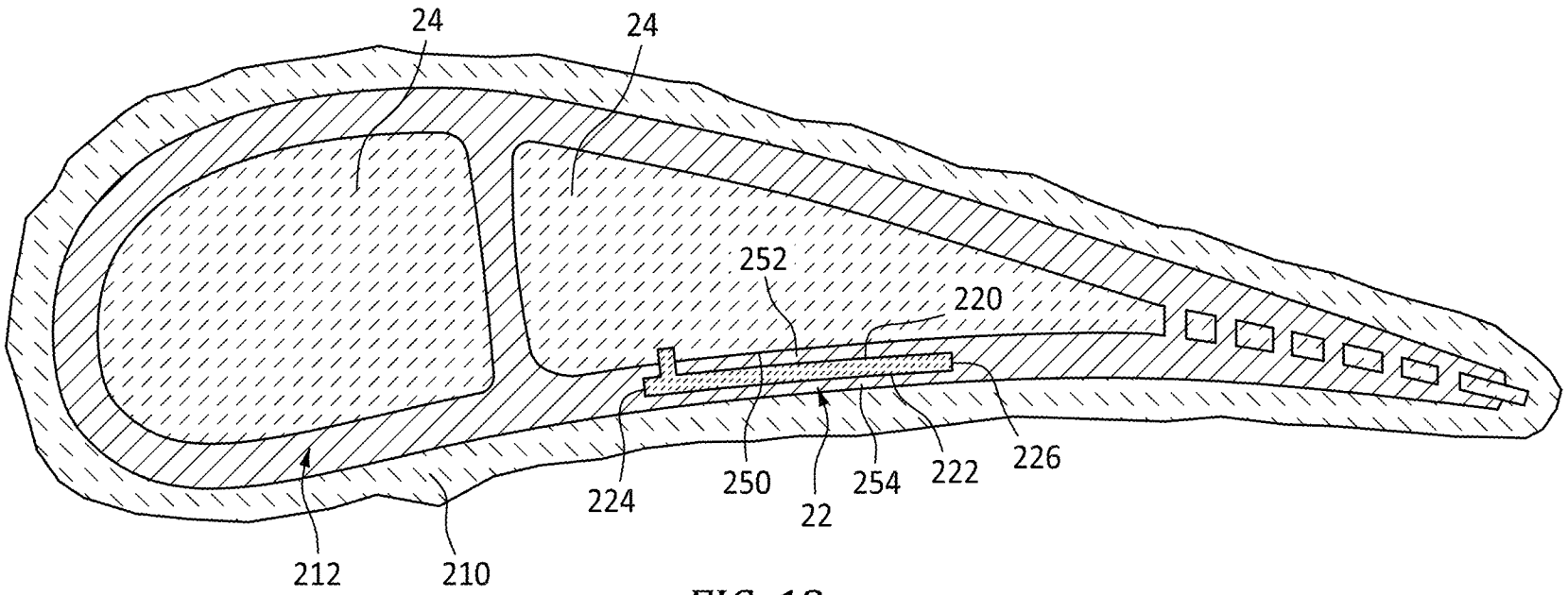
FIG. 13 is a sectional view of an airfoil being cast by a shell containing a core assembly having the post and socket joint.
Figure 14:
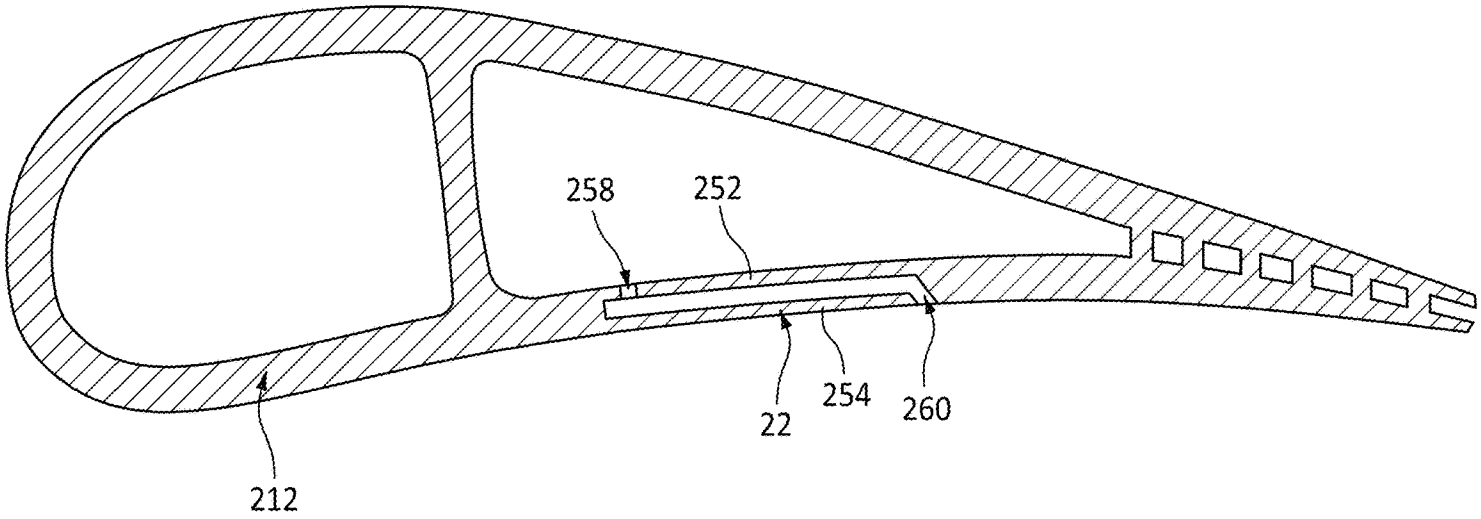
FIG. 14 is a sectional view of the resulting airfoil after outlet hole drilling.
Figure 15:
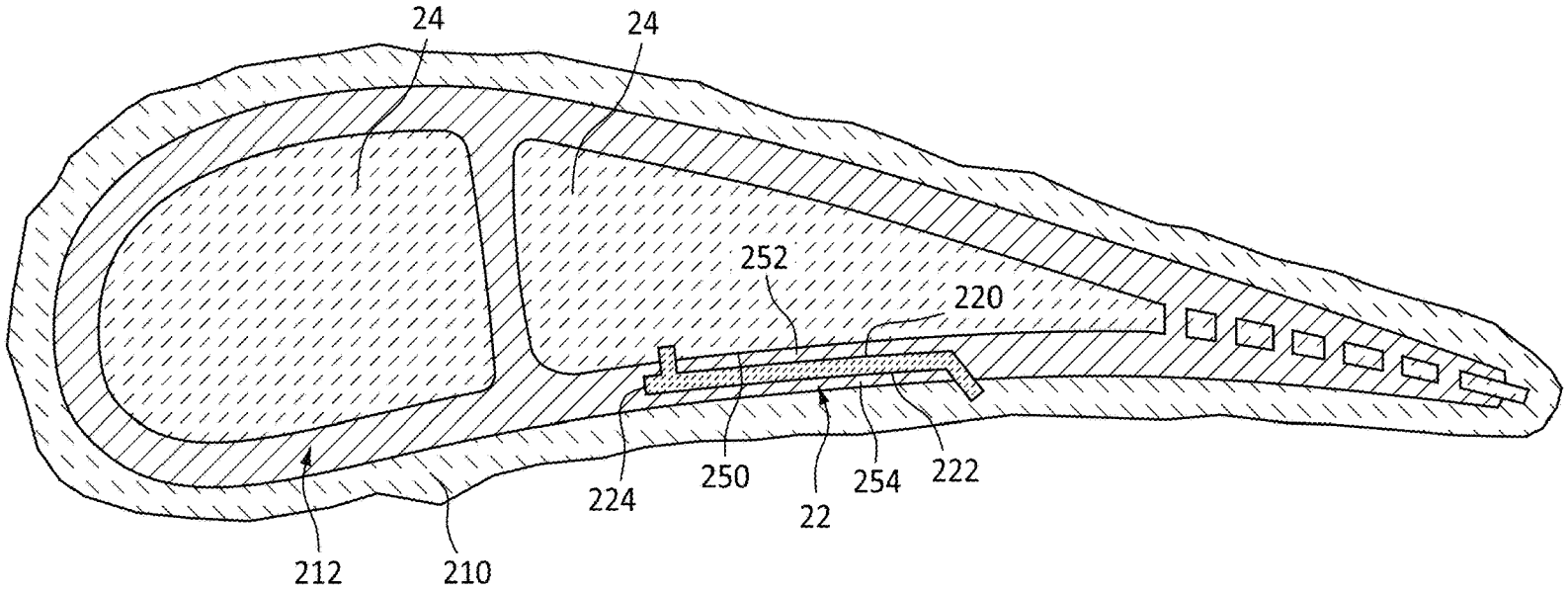
FIG. 15 is a sectional view of an alternate casting shell including a core assembly that itself casts outlets.

FIG. 12 shows one example of the core 22 based on the configuration of the '727 patent. The example has two posts 26 having an on-center spacing Sp. These are in an inboard face 220 which includes the surrounding surface 38. An opposite surface 222 is shown in FIG. 13 discussed below. Core 22 extends from an upstream end 224 to a downstream end 226 and has lateral edges 228 and 230. The core has a series of through holes 232, 234, 236 that cast posts and/or ribs in the associated outlet skin passageway. In this particular example, the holes 234 and 236 segment a plurality of legs which cast generally parallel passageways to outlet passageways discussed below. At the end 226, the legs are joined by intact material 240 in an end region 242. In this particular example, additional bumpers 56 in the end region hold the surface 220 spaced apart from the adjacent surface 250 (FIG. 13) of the core 24 to ensure that interior wall 252 and outer wall 254 are of a desired uniformity of thickness. FIG. 13 shows a schematic assembly of the cores 22 and 24 in a shell 210 casting an airfoil 212. This is a schematic view and in practice there may be additional cores and more complex shapes of cores. After deshelling and decoring (discussed below), outlet holes 260 (FIG. 14) may be drilled into the trailing end of the passageway as cast by the example core 22 (FIG. 14). In FIG. 14, it is seen how the posts have cast passageways 258 that feed the skin passageway from an associated feed passageway cast by the associated section of the core 24. In a further variation for casting of the outlet passageways 260, FIG. 15 shows a modified core wherein a trailing end portion has been bent outward and extended to embed in the shell.

Component materials and manufacture techniques and assembly techniques may be otherwise conventional. Thus, a basic prior art sequence may be used of molding the individual core pieces and firing them to sinter (e.g., in a kiln/furnace). The ceramic paste may be applied (e.g., by injecting into the socket or applying to the tip of the post) and the core pieces may be assembled with posts inserted into the sockets and sufficient pressure applied to displace the paste into the lateral gap 50. The resulting assembly may then be heated to cure the paste. For example, it may be fired (e.g., in a kiln/furnace or, perhaps, locally fired such as via torch). Example firing is to a lower temperature than the initial core piece firing and may be below a sintering temperature. Subsequent steps may also be conventional including wax over molding in a wax die to form a pattern, shelling/stuccoing of the pattern, dewaxing and firing to form a shell.

Alloy may be melted and cast in the shell. The resulting raw casting may be deshelled (e.g., mechanical breaking) and decored (e.g., alkaline and/or acid leaching and/or thermo-oxidative removal) and subject to finish machining and subsequent coating or other steps.

Among variations, other features may be added such as the slots of the '727 patent. Additionally, the principles may be applied to other configurations of core and manufacture technique.

The use of "first", "second", and the like in the following claims is for differentiation within the claim only and does not necessarily indicate relative or absolute importance or temporal order. Similarly, the identification in a claim of one element as "first" (or the like) does not preclude such "first" element from identifying an element that is referred to as "second" (or the like) in another claim or in the description.

One or more embodiments have been described. Nevertheless, it will be understood that various modifications may be made. For example, when applied to an existing baseline core configuration, details of such baseline may influence details of particular implementations. Accordingly, other embodiments are within the scope of the following claims.

What is claimed is:

1. A casting core assembly comprising:
a first ceramic piece including a projecting post;
a second ceramic piece including a socket; and
a ceramic filler material between the post and the socket,
wherein in transverse section at at least one location one of the post and socket has a configuration of:
three circumferentially offset radial peaks of a peak radius ($R_{PMAX}$, $R_{SMAX}$); and
three radial troughs of a trough radius ($R_{PMIN}$, $R_{SMIN}$) not more than 98.0% of the peak radius.

2. The casting core assembly of claim 1 wherein:
the socket is a closed-ended socket.

3. The apparatus of claim 1 wherein:
the trough radius is 93.0% to 97.0% the peak radius if said one is the post; and
the trough radius is 93.0% to 97.0% the peak radius if said one is the socket.

4. The casting core assembly of claim 1 wherein in said transverse section at said at least one location the post has:
respective convex regions spanning maxima of the peaks; and
respective essentially straight regions spanning minima of the troughs.

5. The casting core assembly of claim 1 wherein in said transverse section at said at least one location the socket has:
a radius of a minima within 5.0% of a radius of a maxima.

6. The casting core assembly of claim 1 and further comprising:
a second said post and a second said socket and a ceramic filler material between the second post and the second socket.

7. The casting core assembly of claim 6 wherein:
said at least one location forms at least 30% of a depthwise overlap $H_O$ of the post and socket.

8. The casting core assembly of claim 1 wherein:
a separation $H_G$ between the first ceramic piece and the second ceramic piece aside the projection and socket is 0.40 mm to 1.2 mm.

9. The casting core assembly of claim 1 wherein:
the second ceramic piece forms a feedcore; and
the first ceramic piece forms a skin core.

10. The casting core assembly of claim 1 wherein:
the first ceramic piece has one or more bumpers protruding to contact the second ceramic piece.

11. A method for manufacturing the casting core assembly of claim 1, the method comprising:
molding the first and second ceramic pieces;
injecting a ceramic paste into the socket; and inserting the post into the socket partially displacing the ceramic paste and causing the ceramic paste to flow outward at the radial troughs of the post or the radial peaks of the socket.

12. The method of claim 11 further comprising:

firing the first and second pieces after molding.

13. The method of claim 11 wherein:

the inserting also causes the ceramic paste to flow outward between the radial troughs of the post or the radial peaks of the socket.

14. A method for using the casting core assembly of claim 1, the method comprising:

wax overmolding;

shelling to form a shell; and casting an alloy in the shell.

15. The method of claim 14 further comprising:

deshelling and decoring.

16. The method of claim 14 wherein:

the radial troughs are along flats of the post.

17. A casting core assembly comprising:

a first ceramic piece including a projecting post;

a second ceramic piece including a socket; and a ceramic filler material between the post and the socket, wherein the post and socket are shaped so that with the post centered within the socket in transverse section at at least one location the post and socket define a gap having:

three circumferentially offset first locations of local minimum radial span; and three circumferentially offset second locations of local maximum radial span.

18. A method for forming the casting core assembly of claim 17, the method comprising:

introducing a ceramic paste into the socket; and inserting the post into the socket.

19. The method of claim 18 wherein:

the second locations of local maximum radial span are at outward recesses in the socket or flats of the post.

20. A casting core assembly comprising:

a first ceramic piece including a projecting post;

a second ceramic piece including a socket; and a ceramic filler material between the post and the socket, wherein the post and socket are shaped to provide means for improving flow of the ceramic filler while preserving a centering effect.

* * * * *